US005651843A

United States Patent [19]

Bendel et al.

[11] Patent Number: 5,651,843

[45] Date of Patent: Jul. 29, 1997

[54] MEANS FOR PREDICTING PREFORMANCE OF STAINLESS STEEL ALLOY FOR USE WITH SURGICAL NEEDLES

[75] Inventors: Lee P. Bendel, Lebanon; Timothy Sardelis, Somerset; Lawrence P. Trozzo, South Somerville; Leon K. Stungurys, Middlesex; Hugo R. Florez, Bridgewater; Jeffrey T. Lavin, Milford; Matthew J. McGrane, Three Bridges; Jeffrey K. McVey, Lambertville, all of N.J.

[73] Assignee: Ethicon, Inc., Somerville, N.J.

[21] Appl. No.: 654,812

[22] Filed: May 29, 1996

Related U.S. Application Data

[63] Continuation of Ser. No. 407,932, Mar. 21, 1995, abandoned, which is a continuation of Ser. No. 212,670, Mar. 10, 1994, abandoned, which is a continuation of Ser. No. 987,864, Dec. 9, 1992, abandoned.

[51] Int. Cl.[6] ..... C22C 38/44

[52] U.S. Cl. ..... 148/327; 420/53

[58] Field of Search ..... 420/52, 53, 54; 148/325, 326, 327

[56] References Cited

U.S. PATENT DOCUMENTS

| | | | |
|---|---|---|---|
| 2,432,617 | 12/1947 | Frank s et al. | 420/53 |
| 3,769,003 | 10/1973 | Kenyon | 75/128 W |
| 3,925,064 | 12/1975 | Takamura et al. | 75/128 A |
| 4,740,353 | 4/1988 | Cogan et al. | 420/49 |
| 4,775,426 | 10/1988 | Murley et al. | 148/2 |
| 5,000,912 | 3/1991 | Bendel et al. | 420/34 |

FOREIGN PATENT DOCUMENTS

| | | | |
|---|---|---|---|
| 56-108860 | 8/1981 | Japan | 420/53 |
| 63-145751 | 6/1988 | Japan | C22C 38/50 |
| 10605 SE | 10/1991 | Sweden . | |
| 670 102 | 5/1989 | Switzerland | C22C 38/50 |
| 395489 | 11/1972 | U.S.S.R. | C22C 39/20 |
| 395489 | 8/1973 | U.S.S.R. | 420/53 |
| 745 106 | 2/1956 | United Kingdom | 420/53 |
| WO 93/07303 | 4/1993 | WIPO | C22C 38/50 |

OTHER PUBLICATIONS

Martensite, E.R. Petty, Longman, Bristol, 1970, pp. 161–176, 183–186.

*Primary Examiner*—Sikyin Ip
*Attorney, Agent, or Firm*—Paul A. Coletti

[57] ABSTRACT

A new and useful predictor for maraging stainless steel alloys is created, called the martensite finish temperature, $M_f$ (° F.). This formula enables one to predict the temperature at which a steel is entirely converted to martensite, and is described as $M_f$=1027—78% Ni—27% Ti—34% Mo. A desirable needle alloy for this amount is nickel at 10%, molybdenum at about 2.7%, and titanium at about 2%.

4 Claims, 10 Drawing Sheets

MEANS FOR PREDICTING PREFORMANCE OF STAINLESS STEEL ALLOY FOR USE WITH SURGICAL NEEDLES

This is a continuation of application Ser. No. 08/407,932 filed Mar. 21, 1995, now abandoned, which is a continuation of Ser. No. 08/212,670 filed Mar. 10, 1994, now abandoned, which is a continuation of Ser. No. 07/987,864 filed Dec. 9, 1992 now abandoned, all applications of which are incorporated by reference herein.

THE FIELD OF THE INVENTION

Generally, this invention relates to the field of steel alloys. More specifically, the alloy of this invention relates to work hardenable, maraging stainless steel. Most specifically, the alloy in this invention relates to a material used in surgical needles formed from work hardenable, maraging stainless steel.

BACKGROUND OF THE INVENTION

Presently, many types of alloys are used in the production of surgical needles. Some such alloys are martensitic stainless steels, austenitic stainless steels, and plated plain carbon steel. These alloys range among materials which exhibit acceptable characteristics regarding corrosion resistance, strength and ductility. Of course, primary among all these factors is strength. Naturally, the ultimate tensile strength of an alloy is ideally as high as possible for use, while not compromising any of the other characteristics of the material. The ultimate tensile strength of the cold drawn precipitation hardening grade steel can be described as a combination of its annealed strength increased by the work hardening response, and added to by precipitation hardening. In general, it is desirable for current chemistries from which needles are formed to have an ultimate tensile strength about equal to 360,000 pounds per square inch (360 ksi), or more.

In general, the alloys on which this application focuses are called maraging stainless steels. This terminology indicates hardening by martensitic transformation, with precipitation hardening by aging. Stainless steel means a relatively high chromium level in the alloy, usually about 12 percent or greater.

The first stage in processing these steels is annealing, or solution treatment. This entails heating the material to a suitable temperature (between 1500° F. and 2100° F.), sufficiently long to place one or more constituent elements into solid solution in the base metal. More preferably, the maraged steels of this invention are solution treated between 1980° F. and 2980° F. The phase change of the solution from an austenitic state to its martensitic state commonly occurs in these alloys during cooling from the elevated temperature of the solution treatment. A rapid cooling rate insures that constituents remain in super saturated solid solution, also avoiding unwanted precipitation that might occur during a slow cool. The transformation to martensite is therefore a diffusionless phase change. Alloy additions remain trapped in solution within the resulting martensite, filling interstitial or substitutional sites of the base metal. In this regard, the additions block dislocation movement and further strain the structural lattice of the alloy. Certain alloy additions may also cause martensite refinement, thus hardening or toughening the alloy due to finer martensite plate spacing.

Next, the alloy is work hardened to gain additional strength. Work hardening is a process which increases the strength of a metal by the addition of mechanical deformation. Any process that increases the resistance to slip or the motion of dislocations in the lattice structure of crystals will increase the strength of the material. In work hardening this resistance is caused by immobile obstacles generated during the deformation process itself. They can be arrays of other dislocations or grain boundaries, the number of which is also increased by the mechanical work.

Finally, precipitation or age hardening is accomplished by aging the alloy at intermediate temperatures, high enough to reactivate both diffusion and the formation of intermetallic compounds. Generally age hardening occurs between temperatures of 750° F. to 1050° F. Typically maraged steels are precipitation hardened between about 825° F. and 975° F. A dispersion of fine precipitates nucleate at dislocations and at martensite plate boundaries, resulting in further hardening of the alloy.

Balancing ultimate tensile strength with corrosion resistance and ductility in maraging steel is difficult to arrange. Many attempts yield high tensile strengths and yet low corrosion resistance, and/or low ductility. Ultimately therefore, it is the goal of this alloy to balance these criteria, in order to produce a strong, ductile and corrosion resistant alloy. Previous systems have attempted to predict the tendency to retain austenite in this regard.

Previously, however, there has been an investigation into alloys in the iron with 12% chromium-system, with variable amounts of nickel, molybdenum and titanium. Previous attempts in predicting the tendency of the steel to retain austenite have been embodied in a number, called the Austenite Retention Index, or ARI. This is seen, for instance, in U.S. Pat. No. 5,000,912 assigned to the common assignee of this invention. There, for some martensitic steels, it has been suggested that the ideal Austenite Retention Index falls between about 17.3% to about 21.4%. However, this index has proved to be inadequate in predicting the amount of austenite which is remaining in the system. Because it is much more valuable to know that the alloy is totally transformed to martensite the use of such indices like the Austenite Retention index do not quite fulfill the requirements of capably producing a useful nickel titanium martensitic steel alloy, which may be useful in making surgical needles.

Another deficiency inherent to the ARI formula is the lack of a capability to predict the amount of Chi phase intermetallic compound in the alloy. When there is increased Chi phase formers in the alloy, this too, results in a loss of ductility. Therefore, this is yet another inadequacy in previous methods of predicting the amount of strength and ductility of the system.

Also, since it is known that the hardening precipitate is a compound containing nickel plus titanium, molybdenum, and tantalum, it is necessary to describe a minimum nickel level to insure adequate hardening.

Of course, once the amount of Chi phase formers, martensitic finish temperature, and minimum nickel level, are derived, it is useful to take these factors and optimize them for amounts of the nickel-titanium-tantalum-molybdenum system percentages so that a final ultimate tensile strength can be predicted. Therefore, a formula to predict ultimate tensile strength based on the amount of these elements present in the alloy would also be useful.

SUMMARY OF THE INVENTION

It is therefore an object of the invention to provide an alloy material which should have not less than 360 ksi ultimate tensile after full processing. The yield bending moments of needles made from this material also should be greater than that of existing needles. For example, for 0.012" diameter needles fabricated out of the subject alloy, an increase of 28% bend strength was found, compared to needles made from alloys currently in use.

The alloy of the invention must also be capable of passing standard corrosion tests, commonly as those described in Federal Specification GG-S-00816c. The materials also should be able to resist corrosion when subjected to 94% relative humidity at 176° F. for up to 100 hours.

It is further an object of the invention to form needles from this alloy which must be able to withstand the bending test described in Federal Specification GG-S-00816c.

It is expected that a minimum of 10.5% chromium is necessary to provide satisfactory corrosion resistance. The maximum chromium level is expected to be about 18%, because it is a strong ferrite former at low nickel levels and a very strong austenite stabilizer at higher nickel levels. It should be noted that it is desirous to have the entire alloy convert from austenitic phase to martensitic phase after cooling from the solution treatment. Some of the other elements to be added form intermetallic compounds with chromium. The amount of chromium remaining in a nickel matrix should exceed about 10.5% after age hardening.

It is also expected that nickel is required to provide an austenitic structure at temperatures of about 1500° F. to 2100° F., which can transform to martensite upon cooling to room temperature. The nickel content required for this function is to be expected in the range of about 4% to about 20%. Nickel must also be present to form a sufficient volume fraction of the various hardening phases of the alloy. The nickel required for this function is expected to be about 5.6% to about 12%.

Additional to the chromium and nickel content would be other elements such as aluminum, cobalt, molybdenum, niobium, tantalum, titanium, vanadium and tungsten. These elements could possibly be added primarily because of their influence on annealed strength, age hardening response and work hardening rate.

With these criteria in mind, it has been found in U.S. Pat. No. 5,000,912, incorporated herein by reference, that an acceptable maraging steel has more than a certain tensile strength when obtaining the following chemistries. The alloy is an iron base material in which the chromium content varies from about 11½% to about 12½% by weight. Nickel content should be no less than about 6.3% and range no higher than about 9.5%. For a benchmark in the chemistry, it has been found that the total of nickel and chromium should add to about 21%. Any combination of titanium and tantalum should be at least 1.5% and no higher than about 2.1%. Titanium alone, at about 2% by weight, results in a desirable configuration of the alloy.

Molybdenum should exist in the alloy at about 3.0% with a maximum of about 4.0%. The remainder of the alloy is iron, with trace elements (no more than 0.1% of sulphur, carbon, oxygen, nitrogen, phosphorous, silicon and manganese.

These alloys, because they contain nickel and titanium in large quantities, and form the intermetallic compound $Ni_3Ti$ are commonly referred to as NiTi alloys. It has been found that the NiTi elements produce an ultimate tensile strength of well over 360 ksi, while maintaining high ductility and corrosion resistance.

It is further an object of the invention to predict the martensitic finish temperature, $M_f$, the percent nickel and the Chi phase present in the system. It is further useful to be able to predict the ultimate tensile strength of the stainless steel alloy. Therefore, the object of the invention is to methodically predict such alloys, to optimize the ultimate tensile strength of the alloy.

Further, it has been found that it may be useful to plot graphs which were developed from the following formulas:

$$UTS_{(ksi)}=216+(5.7*\%\ Ni)+(46.4*\%\ Ti)+(9.8*\%\ Mo)+(30.5*\%\ Ta)$$

$$Mf_{(°\ F.)}=1027-(78*\%\ Ni)-(27*\%\ Ti)-(34*\%\ Mo)$$

$$\text{Percent Nickel}=5.6_{minimum}$$

$$CHI_{tendency}=\%\ Ti+\%\ Mo$$

These formula were developed by mathematical comparison of ultimate tensile strength, martensitic finish temperature, percent nickel and percent Chi phase to the various chemical compositions which were melted. Then, the following conditions must be applied: The ultimate tensile strength must equal at least 360 Ks[1] for a strong needle wire. Further, it is desirable to have a martensitic finish temperature which is at least 70° F., or room temperature, in order to produce a ductile needle wire. The percent nickel must be greater then 5.6% for strong, ductile needle wire. Finally, the Chi phase must not be present, again in order to produce a ductile needle wire.

From these formulas, graphs have been developed and the inventors have been able to predict the amount of elements necessary to have a strong ductile surgical grade stainless steel martensitic needle wire or shaft. Therefore, the optimal amounts of these elements have been plotted, and tested, and indeed pass or fall at the predicted levels.

This invention will be better understood by the following Description of the Drawings when taken in conjunction with the Detailed Description of the Invention.

DETAILED DESCRIPTION OF THE INVENTION

Figure 1:
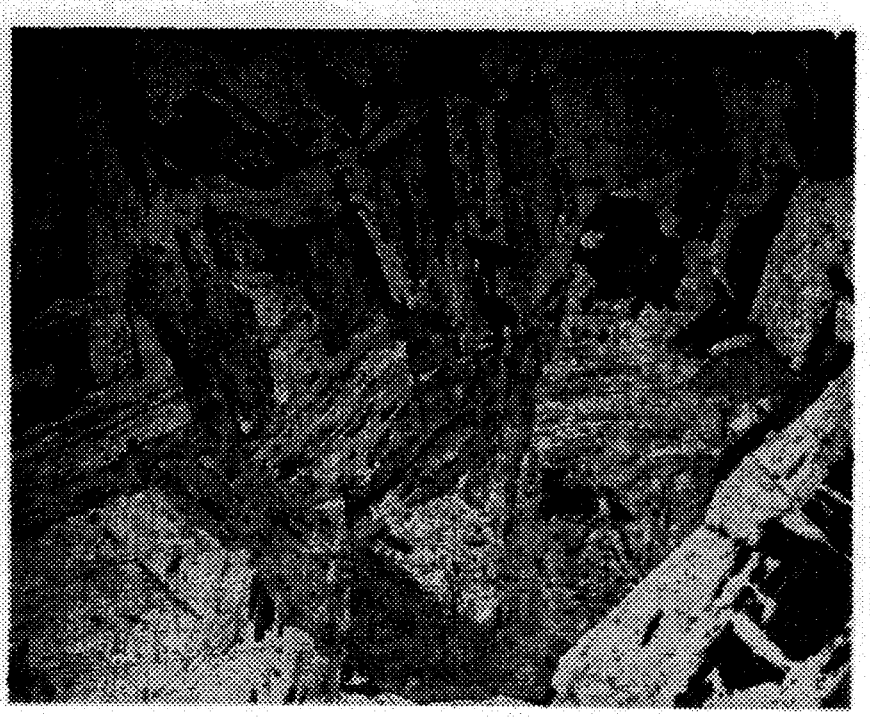
FIG. 1 is a scanning electron microscope photograph of the typical martensite matrix.

Therefore, in the current alloy improvement program undertaken by the assignee of the invention, a number of five pound sample heats were melted from which the prototype alloy could be tested. Naturally, these heats would be processed under many different conditions, and then tested for ultimate tensile strength, ductility and resistance to corrosion.

After the initial program, it was desired to undergo a program where a small number of the more promising five pound heats would be produced in 100 lb. prototype runs. After this production run, similar tests were undertaken in order to further refine the product. Finally, an optimal design was chosen, the design being selected for manufacturing purposes, including the manufacture of 3000 lb runs.

Tables 1a and 1b show the actual chemistries of each of the chemical compositions tested for various performances. The table reports only those elements which by weight had a greater than 0.5% amount as measured in the chemistry.

TABLE 1a

CHEMICAL COMPOSITION OF 5 POUND EXPERIMENTAL HEATS

| ALLOY | CHEMISTRY (Weight Percent) | | | | |
|---|---|---|---|---|---|
| NUMBER | Chromium | Nickel | Titanium | Molybdenum | Other |
| 1 | 11.86 | 7.46 | 1.50 | 4.04 | |
| 2 | 11.93 | 6.57 | 0.95 | 4.03 | |
| 4 | 11.86 | 6.53 | 1.98 | 4.04 | |
| 6 | 11.86 | 8.32 | 1.94 | 4.04 | |
| 7 | 11.87 | 8.40 | 0.84 | 4.03 | |
| 9 | 11.79 | 6.89 | 1.99 | 0 | |
| 10 | 11.91 | 7.48 | 1.50 | 0 | 0.98 Ta |
| 12 | 11.92 | 7.52 | 1.49 | 2.01 | |
| 13 | 11.92 | 6.65 | 0.98 | 0 | |
| 16 | 11.88 | 7.57 | 1.52 | 0 | |
| 20 | 11.92 | 7.54 | 1.48 | 2.01 | 0.98 Ta |
| 21 | 11.88 | 8.40 | 1.96 | 0 | |
| 23 | 11.90 | 8.41 | 1.00 | 0 | |
| 29 | 11.79 | 6.87 | 2.43 | 5.02 | |
| 30 | 11.90 | 8.53 | 2.53 | 4.03 | |
| 31 | 11.98 | 8.54 | 2.03 | 5.03 | |
| 32 | 11.91 | 8.47 | 2.54 | 5.05 | |
| 33 | 11.99 | 13.68 | 2.07 | 4.00 | |
| 34 | 12.01 | 11.80 | 1.98 | 3.98 | |
| 49 | 11.91 | 9.51 | 2.17 | 2.72 | |
| 56 | 12.19 | 4.76 | 2.18 | 2.43 | |
| 59 | 11.83 | 4.57 | 2.31 | 2.31 | |
| 60 | 11.80 | 5.55 | 2.51 | 2.32 | |
| 61 | 11.86 | 10.26 | 2.05 | 0 | |
| 62 | 11.80 | 5.56 | 2.50 | 2.33 | |
| 63 | 11.79 | 6.49 | 2.16 | 2.34 | |
| 64 | 11.78 | 6.50 | 2.54 | 2.34 | |

TABLE 1b

CHEMICAL COMPOSITIONS OF 50 POUND AND PRODUCTION NUTS

| ALLOY | CHEMISTRY (Weight Percent) | | | |
|---|---|---|---|---|
| NUMBER | Chromium | Nickel | Titanium | Molybdenum |
| 102B | 11.48 | 8.27 | 1.88 | 4.06 |
| 102C | 11.46 | 8.24 | 1.86 | 4.60 |
| 103A | 12.30 | 10.32 | 1.93 | 4.28 |
| 103C | 11.94 | 12.53 | 1.85 | 4.18 |
| 105A | 12.06 | 8.23 | 1.85 | 3.04 |
| 105B | 11.92 | 8.88 | 1.80 | 3.47 |
| 105C | 11.79 | 9.33 | 1.78 | 4.06 |
| 106A | 12.00 | 7.90 | 1.91 | 4.73 |
| 106B | 12.30 | 8.50 | 1.93 | 4.77 |
| 106C | 12.29 | 8.90 | 1.92 | 4.80 |
| 107A | 11.90 | 9.53 | 1.91 | 2.99 |
| 107B | 11.85 | 10.38 | 1.87 | 2.95 |
| 107C | 11.73 | 11.27 | 1.89 | 2.94 |

TABLE 1b-continued

CHEMICAL COMPOSITIONS OF 50 POUND AND PRODUCTION NUTS

| ALLOY | CHEMISTRY (Weight Percent) | | | |
|---|---|---|---|---|
| NUMBER | Chromium | Nickel | Titanium | Molybdenum |
| 108A | 11.95 | 8.50 | 1.87 | 3.46 |
| 108B | 11.91 | 8.47 | 1.88 | 3.66 |
| 108C | 11.93 | 8.45 | 2.03 | 3.66 |
| 109A | 11.87 | 10.13 | 2.05 | 2.87 |
| 109B | 11.81 | 10.30 | 2.23 | 3.05 |
| 110A | 11.86 | 9.45 | 1.79 | 2.31 |
| 110B | 11.79 | 9.55 | 1.94 | 2.47 |
| 1983B | 12.70 | 8.13 | 1.78 | 3.79 |
| 2177B | 11.76 | 8.52 | 1.84 | 3.75 |
| 2219B | 11.63 | 8.48 | 1.86 | 3.80 |
| 2527B | 12.16 | 8.79 | 1.84 | 3.20 |
| 3400B | 12.08 | 10.22 | 1.96 | 2.72 |
| 3404B | 12.25 | 9.88 | 2.06 | 2.42 |

The invention will now be described in relation to the various different processes that went into the formulation of a material to satisfy the objects of the invention. A general study attempted to narrow the factors before arriving at an alloy program. The study was conducted to determine the total strength of many different alloy chemistries. The goal was to develop chemistries which would surpass strength levels of current alloys. The primary objective was to characterize the effectiveness of each particular alloy addition, and provide a screening tool for future alloy candidates. Ultimately, a comparison of the benefits of strengthening, through alloy heat treatment, with benefits from work hardening during drawing the alloy were explored. Thus, some attention was made to the constraints of needle or wire production.

A number of chemistries was selected to optimize particular alloy additions. Each five pound alloy heat was custom melted. Rods of the alloys were lathe cut to provide four approximate three inch lengths. These lengths of rod were solution treated (annealed) at a prescribed temperature, and afterwards cut to quarter inch length coupons for subsequent processing. Each solution treatment retained one coupon for hardness testing in the annealed state, and the remaining coupons for precipitation hardening (aging evaluation). Ferromagnetism for one coupon was tested at each annealing temperature. This attraction was used to indicate relative amounts of martensite present in the matrix, which can be seen, for instance, in FIG. 1.

Individual sample alloy coupons were treated for annealing purposes at four different temperatures: 1700°, 1800°, 1900° and 2000° F. Solution treatment entailed a one hour anneal followed by water quenching to room temperature. After cutting the coupons, they were precipitation hardened at temperatures between 850° F. and 1125° F. Precipitation hardening entailed a four hour age, followed by air cooling.

Initially, each of these alloy coupons were aged at four different temperatures spanning the precipitation hardening range. Based on the aging response, intermediate temperatures were added until pinpointing a "maximum tensile strength". Tests were conducted with a Rockwell hardness tester using a 150 kg preload and a diamond indentor. Rockwell "C" scale hardness readings were converted to approximate ultimate tensile equivalents, using conversions provided by Rockwell.

Test coupon preparation/slicing produced two parallel surfaces by lathe cut. These were lightly sanded to remove burrs and machine marks. Five hardness impressions were taken on each coupon—one central reading plus four evenly spaced from the center. We averaged all five measurements, and then ultimate tensile strength was converted from the hardness scale.

Table 2 examines a number of the results of the 5 lb. heats. First, through the corresponding alloys from Table 1a, it is determined whether the alloy underwent change from austenite to martensite. In cases where material remained austenitic, this coupon received a greatly abbreviated aging study. Also reported is the optimum tensile strength reached, which is a combination of the response due to annealed strength, and the precipitation hardening response. Thus, the change or "delta" response indicates the precipitation hardening response. Also indicated is the annealing strength reached, and temperature used at annealing. Aging temperature is indicated for the precipitation hardening temperature found to be the most desirable for each alloy.

hardening that might otherwise occur from wire drawing. It should be noted that in the bulk test, a maximum tensile strength was attained at the same temperature as the maximum change in age hardening response.

From these initial bulk tests we drew the following conclusions. First, several chemistries surpass the tensile strength of typical needle wire grades. Solution treatment alone of these several chemistries provided tensile strengths from 120 ksi to 150 ksi, and was optimized at 1800° F. to 2000° F. Precipitation hardening of the same chemistries reached overall strength from 250 ksi to 290 ksi. Precipitation hardening was found to be most effective for these chemistries in the vicinity of 925° F. All four elements used in the alloys were solid solution hardeners and raised the annealed tensile strength of the alloys.

Titanium, molybdenum, and tantalum form precipitates with nickel further increasing the response or change in tensile strength through aging. Titanium was the most effective in this regard. It was derived that titanium in a range between about 1% and about 2% by weight provided by far the greatest contribution to total heat treat response. Nickel probably responded best at around 2000° F. solution treatment. All NiTi chemistries tested in this run most likely converted to martensite upon quenching to room temperature after solution treatment, except for those alloys which never converted from austenitic. Alloys which did not convert had more than 9.5% nickel. Alloys with less than 9.5%

TABLE 2

5-POUND HEATS
COUPON HEAT TREATMENTS

| ALLOY NUMBER | MAGNETIC ATTRACTION AFTER 2000 ANNEAL | TENSILE STRENGTH AFTER 2000 ANNEAL (KSI) | AGING TEMP USED (DEG F) | TENSILE STRENGTH AFTER AGING (KSI) | HEAT TREAT DELTA RESPONSE FROM AGING (KSI) |
|---|---|---|---|---|---|
| 1 | YES | 122 | 975 | 242 | 120 |
| 2 | YES | 120 | 950 | 211 | 91 |
| 4 | YES | 124 | 1000 | 230 | 106 |
| 6 | YES | 134 | 975 | 268 | 134 |
| 7 | YES | 131 | 950 | 212 | 81 |
| 8 | YES | 133 | 950 | 260 | 127 |
| 9 | YES | 122 | 950 | 254 | 132 |
| 10 | YES | 124 | 950 | 253 | 129 |
| 12 | YES | 127 | 925 | 247 | 120 |
| 13 | YES | 121 | 950 | 204 | 83 |
| 15 | YES | 127 | 950 | 237 | 110 |
| 16 | YES | 120 | 950 | 234 | 114 |
| 20 | YES | 137 | 950 | 267 | 130 |
| 21 | YES | 126 | 925 | 271 | 145 |
| 22 | YES | 133 | 950 | 248 | 115 |
| 23 | YES | 121 | 925 | 219 | 98 |
| 24 | YES | 140 | 975 | 274 | 134 |
| 29 | YES | 137 | 1000 | 235 | 98 |
| 30 | YES | 142 | 950 | 281 | 139 |
| 31 | YES | 141 | 950 | 263 | 122 |
| 32 | YES | 149 | 950 | 290 | 141 |
| 33 | NO | 72 | 950 | 72 | 0 |
| 34 | NO | 72 | 900 | 72 | 0 |
| 49 | YES | 122 | 900 | 269 | 147 |
| 56 | YES | 110 | 975 | 151 | 41 |
| 59 | YES | 103 | 1000 | 136 | 33 |
| 60 | YES | 108 | 975 | 202 | 94 |
| 61 | YES | 121 | 900 | 270 | 149 |
| 62 | YES | 112 | 975 | 202 | 90 |
| 63 | YES | 121 | 950 | 226 | 105 |
| 64 | YES | 117 | 975 | 228 | 111 |

As can be seen from the tables above, the initial studies in this system all have a nominal chromium composition of 11.9%. This amount is believed sufficient to render good corrosion resistance for stainless steel. Nickel is studied from about 4.5 to 13.7%, optimally between 6.5% and 9.5%. Titanium is studied from 1 to 2.5%. Molybdenum is studied from 0 to 5%. Of secondary importance are the additions of tantalum at 1%.

The preceding data was limited to bulk heat treat response, that is, response without a component from work nickel were ferromagnetic and showed heavy magnetic attraction when placed in a magnetic field.

Thus, when drawn to wire, any change in heat treat response was due to strain induced effects. Of course, reevaluation was recommended of alloy response after cold working these alloys, which was done for the larger heats. In addition, examination of the microstructures may further explain the phases present and different hardening responses in the alloys.

These initial alloys were then subjected to corrosion tests. As a result of these tests, all the above NiTi alloys passed copper sulfate corrosion tests outlined in interim Federal Specification GG-S-00816C, incorporated herein by reference. It was found that as a function of the percent chromium or any single alloy addition, the incidence of corrosion did not vary as a function of tensile strength.

Work hardening response for the alloys from series 1 to 24 and the aging response of maraged stainless steels drawn into needle wire were then tested. The alloys were received as 0.250 inches round stock. The rod was drawn to wire using one or both of the following processes. In the first process, the rod was annealed at 2000° F., swaged to 0.218 inches, further annealed at 2000° F., drawn from 0.218 inches to 0.073 inches. The resulting wire was annealed at 2000° F. and drawn from 0.073 to 0.022 inches. Alternately, in the second process, the rod received as 0.250 inch round was annealed at 2000° F. Then the rod was drawn from 0.250 to 0.101 inches. This wire was annealed at 2000° F. and drawn from 0.101 inches to 0.022 inches.

Tensile tests were then performed in the annealed condition and as drawn to the following diameters: 0.030 inches, 0.024 inches, 0.022 inches. Further tensile tests were performed on the material when drawn to 0.022 inches and aged as 875° for one hour and then air cooled. In addition, other tensile tests were performed on wires drawn to 0.022 inches and then aged at 950° for one hour and then air cooled.

Table 3 demonstrates the annealed tensile strength before drawing and the tensile strength as drawn to 0.022 inches and the aging response resulting from the aging of the material. The work hardening rate (WHR) of the alloys was determined by plotting the ultimate tensile strength (UTS) of "as-drawn" wire versus the natural log of the change in length. The slope of the resulting curve is the WHR of the alloy. The UTS of the alloy at various wire sizes can be calculated according to the following formula:

$$UTS = \text{annealed tensile strength} + WHR * Ln\Delta L,$$

where $\Delta L$=final length÷original length

The total UTS column demonstrates the ultimate tensile strength of the alloys as drawn to wire at 0.022 inches plus aged and the last column demonstrates ductility.

TABLE 3

| HEAT | Ann UTS (ksi) | If/Io | WHR | AS-DRAWN UTS (ksi) | AVG AGE RESP (ksi) | TOTAL UTS (ksi) | DUCTILITY (acc/rej) |
|---|---|---|---|---|---|---|---|
| 1 | 147 | 11 | 34 | 229 | 93 | 322 | acc |
| 2 | 134 | 11 | 30 | 205 | 77 | 282 | acc |
| 4 | 137 | 11 | 33 | 218 | 105 | 323 | rej |
| 6 | 147 | 21 | 34 | 254 | 113 | 367 | rej |
| 7 | 137 | 11 | 24 | 193 | 80 | 273 | acc |
| 10 | 129 | 21 | 22 | 194 | 101 | 295 | acc |

TABLE 3-continued

| HEAT | Ann UTS (ksi) | If/Io | WHR | AS-DRAWN UTS (ksi) | AVG AGE RESP (ksi) | TOTAL UTS (ksi) | DUCTILITY (acc/rej) |
|---|---|---|---|---|---|---|---|
| 12 | 132 | 21 | 28 | 218 | 92 | 310 | acc |
| 13 | 121 | 21 | 23 | 192 | 59 | 251 | acc |
| 16 | 136 | 11 | 17 | 178 | 84 | 262 | acc |
| 20 | 144 | 21 | 33 | 242 | 96 | 338 | acc |
| 21 | 122 | 11 | 25 | 183 | 100 | 283 | acc |
| 23 | 137 | 11 | 32 | 214 | 95 | 309 | acc |

While the WHR of an alloy is useful in determining the strength of as-drawn wire, it is more useful to be able to predict the UTS of wire in the finished state, that is, as drawn plus age hardened state. It was therefore desired to develop a mathematical relationship between the as-drawn plus aged tensile strength (Total UTS), and the chemical composition of the alloys tested. The Total UTS data in Table 3 were used to determine this relationship. SAS™ statistical software was used to develop a mathematical relationship between the chemical composition of NiTi alloys and the Total UTS obtained after cold work and age hardening.

A model was formulated which included a linear term for each constituent element. For the elements that made a significant contribution to the Total UTS, a coefficient was determined to quantify its individual contribution:

$$UTS_{(ksi)} = 216 + (5.7*\%\ Ni) + (46.4*\%\ Ti) + (9.8*\%\ Mo) + (30.5*\%\ Ta)(1)$$

A measure of the goodness-of-fit to the data is the Coefficient of Determination, or R-squared value. An $R^2$ value of 1.0 indicates a model with a perfect fit (i.e., one in which the predicted values equal the observed values). The better model fits the data the closer the $R^2$ value is to 1.0. The $R^2$ value obtained for the data modeled is 0.85. This indicates that the model fits the data well.

Ductility

Bend tests were performed to test ductility, using criteria developed from a utility tester. This ductility tester consisted of five major parts: sample-holding clamp; bidirectional, variable-speed stepping motor; strain gauge load cell; load cell adapter; and horizontal and vertical vernier load cell positioners.

The sample-holding clamp is used to secure each test sample firmly. This clamp is mounted on the shaft of a variable-speed motor that can rotate the clamp in either clockwise or counterclockwise rotational directions. The stepping motor rotates the sample clamp at a fixed speed about an axis normal to the plane of sample curvature. The center of rotation is located on the line formed by the front faces of the two jaws and centered between the two jaws. For this ductility test, the stepping motor speed is calibrated to rotate the sample at a constant angular speed. In preliminary studies, the influence of rotational speed on sample ductility was assessed by performing ductility tests on selected needles at speeds of either 1.5 or 3.0°/sec. All subsequent ductility studies were undertaken using a rotational speed of 3.0°/sec.

The steel load cell adapter consisted of a carbide knife edge. This adapter was rigidly attached to a strain gauge load cell that was sensitive only to vertical forces imparted to the adapter. The sample was positioned on the knife edge of the adapter and secured to the clamp. As the clamp securing the sample was rotated, the sample was forced against the knife edge, imparting a bending load on the sample. An important feature of this adapter was its ability to create bending forces as the clamp was rotated. As a result of this capability, bend forces could be recorded as each test sample was bent clockwise through an arc of about 84°.

Before the test, the load cell and adapter were positioned using the horizontal and vertical verniers so that the sample held by the clamp would rest on the knife edge. The knife edge was always positioned at the same vertical level as the center of clamp rotation to minimize friction and lateral forces. The horizontal vernier then was adjusted to set the bending moment arm for the test.

During the test, the sample was rotated 84° onto the knife edge and permanently deformed. This rotation resulted in a combination of elastic and plastic (permanent) deformation. During this 84° of angular deformation, the strip chart recorder (Hewlett-Packard Company, San Diego, Calif.) plotted the vertical bend force sensed by the load cell as a function of the angular rotation of the clamp. The bending moment (M) exerted on the test needle was calculated using the equation M=Fx, where F is the vertical bend force applied to the needle and x is the moment arm of the test, defined as the distance from the center of the knife edge to the center of rotation of the clamp.

Careful examination of the strip chart recording of vertical bend forces sensed by the load cell as a function of the angular rotation permitted the bend angle to cause fracture to be determined. The onset of fracture was indicated by a sudden drop in vertical force. In this study, all samples which exhibited a sudden drop in force were considered not acceptable in ductility. Samples which did not exhibit a drop in force prior to reaching the 84° limit of the tester were considered acceptable.

The purpose of choosing these criteria was to determine the upper limits for the hardening elements titanium, tantalum and molybdenum, the upper limit for M? temperature, and the upper limit for ΔL in the alloy system.

Wire Drawing

The NiTi alloys were then processed according to one of the following two wire drawing processes.

EXAMPLE I

1. Rod received at 0.225" diameter.
2. Intermediate draw, up to four times original length.
3. Intermediate anneal at 2020° F.
4. Repeat steps 2 and 3 until final breakdown size is reached.
5. Final anneal at 2020° F.
6. Final draw, from 11× to 50× original length.

Final length change was determined by a heat's ability to achieve the desired strength while maintaining acceptable ductility. If the desired final UTS was achieved or the sample failed for ductility, the drawing was stopped. Heats which did not achieve sufficient strength with a length change of fifty times the original length, were considered unacceptable for work hardening properties. The results are summarized in Table 4a.

TABLE 4A 50 pound and Production Heats

| HEAT | Ann UTS (ksi) | If/Io | WHR | AS-DRAWN UTS (ksi) | AVG AGE RESP (ksi) | TOTAL UTS (ksi) | DUCTILITY (acc/rej) |
|---|---|---|---|---|---|---|---|
| 102B | 148 | 50 | 34 | 253 | 136 | 419 | rej |
| 102C | 160 | 11 | 34 | 240 | 107 | 347 | rej |
| 103A | 110 | 12 | 62 | 260 | 83 | 343 | rej |
| 103C | 84 | 12 | 63 | 239 | 87 | 326 | rej |
| 105A | 154 | 50 | 30 | 271 | 137 | 407 | acc |
| 105B | 153 | 50 | 31 | 275 | 125 | 400 | acc |
| 105C | 157 | 50 | 34 | 286 | 140 | 426 | rej |
| 106A | 149 | 50 | 40 | 307 | 133 | 439 | rej |
| 106B | 154 | 50 | 39 | 311 | 138 | 449 | rej |
| 106C | 149 | 50 | 40 | 308 | 125 | 433 | rej |
| 107A | 150 | 26 | 30 | 254 | 139 | 393 | acc |
| 107B | 138 | 26 | 31 | 243 | 138 | 381 | acc |
| 107C | 110 | 37 | 52 | 297 | 148 | 428 | rej |
| 108A | 157 | 37 | 37 | 290 | 124 | 414 | acc |
| 108B | 158 | 37 | 35 | 286 | 128 | 414 | acc |
| 108C | 162 | 37 | 37 | 296 | 129 | 425 | acc |
| 109A | 149 | 25 | 28 | 239 | 143 | 382 | acc |
| 109B | 147 | 25 | 30 | 245 | 149 | 394 | acc |
| 110A | 153 | 25 | 24 | 229 | 125 | 354 | acc |
| 110B | 157 | 25 | 25 | 240 | 128 | 368 | acc |
| 1983B | 160 | 50 | 38 | 311 | 108 | 419 | rej |
| 2177B | 155 | 50 | 38 | 304 | 127 | 431 | rej |
| 2219B | 155 | 50 | 38 | 295 | 132 | 427 | rej |
| 2527B | 155 | 37 | 35 | 276 | 124 | 400 | acc |
| 3400B | 150 | 25 | 30 | 245 | 145 | 390 | acc |
| 3404B | 150 | 25 | 31 | 250 | 144 | 393 | acc |

EXAMPLE II

1. Rod received at 0.250" diameter.
2. Rod annealed at 2020° F.
3. Intermediate draw, up to four times original length.
4. Intermediate anneal at 2020° F.
5. Repeat steps 3 and 4 until final breakdown size is reached.
6. Final anneal at 2020° F.
7. Final draw, from 11× to 50× original length.

Final length change was determined by a heat's ability to achieve the desired strength while maintaining acceptable ductility. If the desired final UTS was achieved or the sample failed for ductility, the drawing was stopped. Heats which did not achieve sufficient strength with a length change of fifty times the original length were considered unacceptable for work hardening properties. The results are summarized in Table 4b.

TABLE 4b

| HEAT | Ann UTS (ksi) | If/Io | WHR | AS-DRAWN UTS (ksi) | AVG AGE RESP (ksi) | TOTAL UTS (ksi) | DUCTILITY (acc/rej) |
|---|---|---|---|---|---|---|---|
| 29 | 137 | 37 | 32 | 252 | 110 | 366 | acc |
| 30 | 142 | 37 | 43 | 294 | 133 | 423 | rej |
| 31 | 161 | 11 | 41 | 260 | 119 | 379 | rej |
| 32 | 147 | 37 | 41 | 297 | 140 | 437 | rej |
| 33 | 90 | 11 | 66 | 241 | 62 | 303 | rej |
| 34 | 96 | 11 | 76 | 269 | 92 | 361 | rej |
| 49 | 122 | 25 | 32 | 237 | 138 | 375 | acc |
| 56 | 112 | 36 | 36 | 237 | 80 | 317 | acc |
| 59 | 101 | 36 | 30 | 206 | 81 | 287 | acc |
| 60 | 130 | 36 | 36 | 258 | 87 | 345 | acc |

TABLE 4b-continued

| HEAT | Ann UTS (ksi) | If/Io | WHR | AS-DRAWN UTS (ksi) | AVG AGE RESP (ksi) | TOTAL UTS (ksi) | DUCTILITY (acc/rej) |
|---|---|---|---|---|---|---|---|
| 61 | 143 | 36 | 28 | 245 | 99 | 344 | acc |
| 62 | 128 | 36 | 37 | 262 | 97 | 359 | acc |
| 63 | 139 | 36 | 37 | 274 | 95 | 370 | acc |
| 64 | 140 | 36 | 39 | 276 | 108 | 384 | acc |

Speed of response indicated that one to two hours is sufficient to produce 90% or more of the precipitation hardening response. The best combination of strength and ductility among these alloys was therefore found at the martensitic alloy 3400. A tensile strength of 390 ksi was achieved with an aging response of 145 ksi. Ductility surpassed full deflection in the bend test under which we proceeded.

With these new NiTi alloys chosen to evaluate high titanium levels (2% and greater), and molybdenum levels at to 4% or greater, and nickel levels up to 10.5% resulting optimum tensile strengths were grouped at about 400 ksi for all these alloys. These strengths surpass all the earlier chemistries. As a conclusion of these second stage tests, it was reaffirmed that the limit of the combination of molybdenum, titanium and tantalum should be at a maximum of about 5.6, and nickel was determined from these studies to be most beneficial at a level between 5.6% and 10.5%.

Finally, needle wire from heat 3400 (the most desirable heat) was processed into needles using standard needle making equipment, tooling and processes. Tensile strength of the needle wire was higher than normal for typical alloys. Channel forming and point forming studies were also conducted to determine if channels could be punched in the higher strength material and points or sharpened tips could be successfully formed. The needles were compared with present needles made before or after these heat 3400 needles. In conclusion, it was determined that this heat can be successfully processed into needles without major equipment or tooling modifications. Bend strength of the needles made from heat 3400 was 20% to about 28% higher than typical needles made of the same type. This compared favorably with the high tensile strength.

Therefore, in conclusion, these heats when drawn to needle sizes produced ultimate tensile strengths well above 360 ksi. In this regard, it was determined from our studies that such an alloy is highly desirable in use as wire or especially in use as needles.

It was then desired to determine the temperatures at which the various phase transformations start and finish in these nickel titanium alloys, and from them to develop a mathematical relationship between the chemical analysis of the alloy and the martensitic finish temperature, $M_f$ (° F.).

Previous studies have shown that materials that have large amounts of austenite are brittle after drawing and aging. This makes the determination of the martensite finish temperature of considerable value and provides a method to develop chemical composition limits that optimize the resulting properties of a needle alloy.

A Dilatometer measures minute changes in length of a sample during heating or cooling. The ratio of length change versus temperature is typically linear as a result of the uniform expansion or contraction of the atoms. The expansion or contraction will become non-linear if a phase change starts to take place in the alloy. The rate of length change versus temperature either increases or decreases depending upon the atomic spacing of the new phase of the alloy. When the phase change is complete, the ratio again becomes linear. The new slope of this linear ratio depends upon the expansion characteristics of the new phase.

Samples of rod from selected NiTi alloys were chosen for dilatometer testing. The rod samples were cut to 2½" in length, annealed at 2020° F. for 1 hour, followed by a water quench. The samples were then given code numbers, different from their alloy numbers, for identification, and then sent for testing. As a check on the reproductibility of the testing, a sample of alloy 2527B was sent along with each group of samples. In all cases, the testing was done "blind" to the actual alloy identification.

Figure 2:
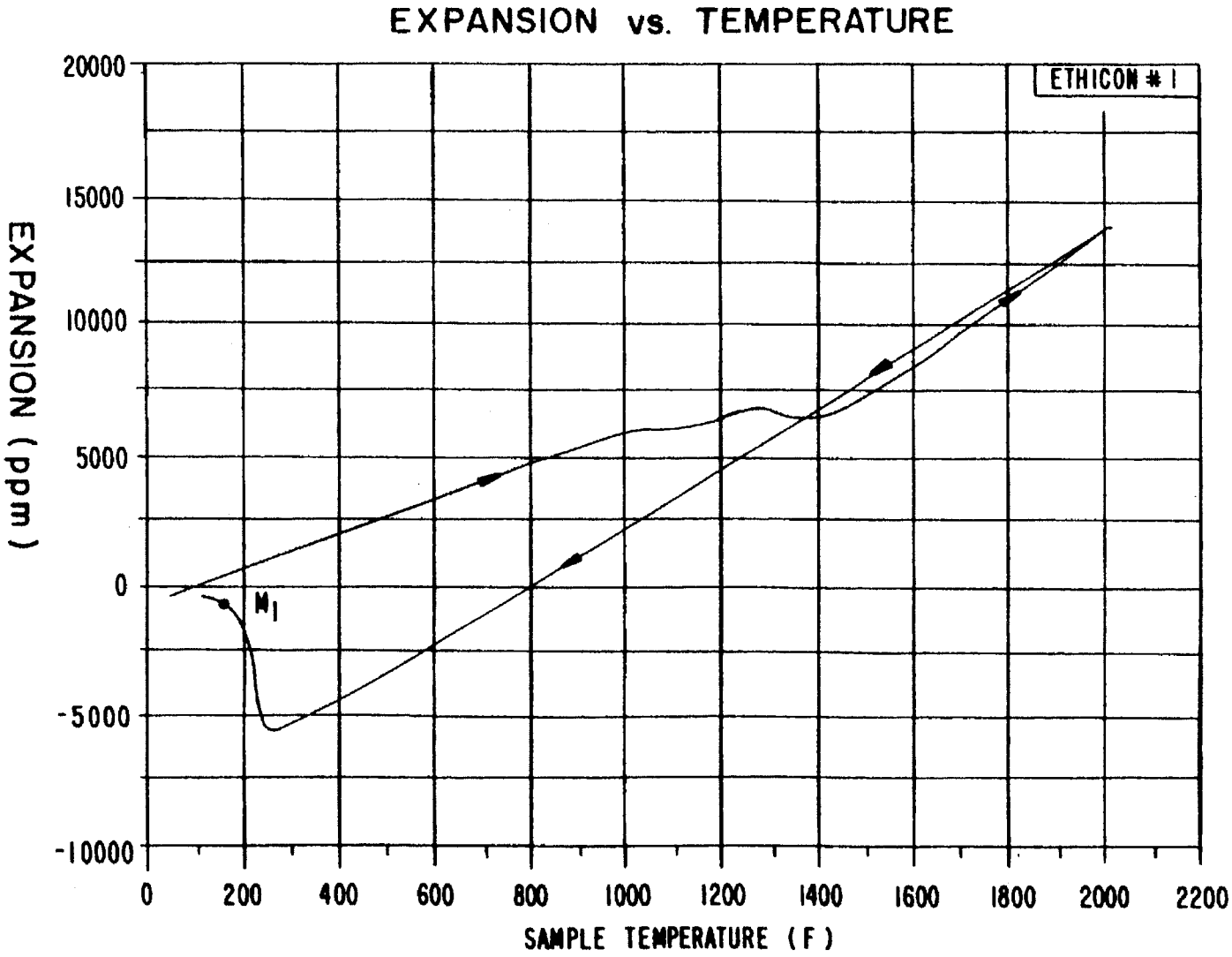
FIG. 2 is a dilatometer curve showing a distinct martensite formation temperature, $M_f$.

The temperature at which phase changes occur can be determined from the changes in slope on a dilatometer curve. FIG. 2 is a sample curve which shows the temperature at which the phase change from austenite to martensite is completed.

The samples were tested in a Unitherm Model 1161 High Temperature Vertical Dilatometer. Each piece was heated to 2020° F. at a rate of 9° F./min. in flowing nitrogen; they were cooled at the same rate. Plots were made of the expansion versus temperature.

The temperatures at which phase changes occur can be determined from the changes in slope on a dilatometer curve. Heat 2527B is a typical sample and is described in FIG. 2. Alloys containing titanium and nickel were previously found to age harden at about 900° F. after two hours. Thus, after two hours, the first slope change observed during heating at 983° F. is attributed to the formation of $Ni_3Ti$ particles. The formation of $Ni_3Ti$ particles is a slow, diffusion process. The difference in temperature between 900° F. and 983° F. results because the dynamic dilatometer tests can not immediately reflect the start of $Ni_3Ti$ formation. The next slope change for heat 2527B, at 1162° F., is attributed to the completion of the formation of $Ni_3Ti$ particles. Determination of these temperatures is of limited value to alloy development, since long term aging is needed to fully develop the $Ni_3Ti$ particles. In contrast, the absence of these slope changes as found in Alloys 34, 37 and 41, indicates that no significant age hardening can occur.

For heat 2527B, the next slope change is observed at 1292° F. This temperature is typical of a phase change from martensite to austenite for iron-base alloys. Another slope change at 1465° F. indicates that the martensite has completely transformed to austenite.

Previous studies have shown that the optimum annealing temperature for age hardening is about 2000° F. Thus, our samples were always well above the austenite formation temperature.

The sample was cooled immediately after reaching the maximum temperature of 2020° F. Changes in slope were observed at 254° F. and 195° F., the start and finish of the phase change from austenite to martensite. Previous studies have shown that materials which have large amounts of retained austenite are brittle after drawing and age hardening. Thus, determination of the martensite finish temperature $M_f$ is of considerable value. Developing a relationship between chemical composition and the M, provides a method to develop chemical composition limits that optimize the resulting properties. The absence of the two slope changes for the alloy, as in alloys 34, 107B and 107C, indicates that these alloys remained austenitic after the Dilatometer test. The absence of the second slope change, as for Alloys 106C and 107A indicates that these alloys were partially austenitic after the Dilatometer test.

The transformation temperatures were determined and are reported in Table 5. Heats 2, 4 and 2527B were tested several times to evaluate the reproductibility of the test method.

TABLE 5

DILATOMETER RESULTS

| ALLOY NUMBER | CHEMISTRY Mo | Ti | Ni | Other | $M_f$ (°F.) |
|---|---|---|---|---|---|
| 2 | 4.03 | 0.98 | 6.57 | | 373 |
| 2 (rep) | " | " | " | | 368 |
| 4 | 4.04 | 1.98 | 6.53 | | 335 |
| 4 (rep) | " | " | " | | 330 |
| 13 | | 0.98 | 6.65 | | 465 |
| 16 | | 1.52 | 7.57 | | 411 |
| 20 | 2.10 | 1.48 | 7.54 | 0.98 Ta | 319 |
| 21 | | 1.96 | 8.40 | | 346 |
| 23 | | 1.00 | 8.41 | | 341 |
| 30 | 4.03 | 2.53 | 8.53 | | 189 |
| 32 | 5.05 | 2.54 | 8.47 | | 124 |
| 34 | 3.98 | 1.98 | 11.80 | | NT |
| 49 | 2.72 | 2.17 | 9.51 | | 151 |
| 106B | 4.77 | 1.93 | 8.50 | | 97 |
| 106C | 4.77 | 1.92 | 8.90 | | NT |
| 107A | 2.99 | 1.91 | 9.53 | | NT |
| 107B | 2.95 | 1.87 | 10.38 | | NT |
| 107C | 2.94 | 1.89 | 11.27 | | NT |
| 108A | 3.46 | 1.87 | 8.50 | | 189 |
| 108B | 3.65 | 1.88 | 8.47 | | 216 |
| 108C | 3.66 | 2.03 | 8.45 | | 184 |
| 109A | 2.87 | 2.05 | 10.13 | | NT |
| 109B | 3.05 | 2.23 | 10.30 | | NT |
| 110A | 2.31 | 1.79 | 9.45 | | 173 |
| 110B | 2.47 | 1.94 | 9.55 | | 157 |
| 2177B | 3.75 | 1.84 | 8.52 | | 184 |
| 2527B | 3.20 | 1.84 | 8.79 | | 184 |
| 2527B (rep) | " | " | " | | 195 |
| 2527B (rep) | " | " | " | | 184 |
| 2527B (rep) | " | " | " | | 205 |
| 2527B (rep) | " | " | " | | 195 |
| 2527B (rep) | " | " | " | | 189 |

note:
NT indicates that No Transformation occured
(rep) indicates a replicate on a new sample of a previously tested heat Statistical software was used to model the martensite finish temperature, $M_f$ (° F.), as a function of the chemistries of the alloys. Linear regression determined the best prediction equation. All alloys with $M_f$, data were included in the initial analysis. A model was formulated which included a linear term for each of Ni, Ti, Mo and the resulting equation was:

$$M_f=1027-(78*\%\ Ni)-(27*\%\ Ti)-(34*\%\ Mo) \quad (2)$$

Again, this model has a high degree of fit ($R^2$=0.97) to the data.

Mathematical modeling attempts to find the "best" prediction model for a set of data. The "best" model for the relationship of $M_f$, to Ni, Mo and Ti was indicated in Equation 2 printed above. The interpretation of a typical model coefficient can be understood as follows: All other factors held constant, a 1-unit increase in (for instance) Nickel content will result in a 78° F. decrease in $M_f$.

Nickel Levels

Alloys were then evaluated to determine a lower nickel limit for the proposed alloy. The alloys were chosen to provide data at two titanium levels for each of three nickel levels. The molybdenum level was held constant. The six alloys provided a clear relationship between nickel and tensile strength. The alloy chemistries are given below:

Actual chemical analysis:

| Alloy | Cr | Ni | Ti | Mo |
|---|---|---|---|---|
| 56 | 12.19 | 4.76 | 2.18 | 2.43 |
| 59 | 11.83 | 4.57 | 2.51 | 2.31 |
| 60 | 11.80 | 5.55 | 2.05 | 2.32 |
| 62 | 11.80 | 5.56 | 2.50 | 2.33 |
| 63 | 11.79 | 6.49 | 2.16 | 2.34 |
| 64 | 11.78 | 6.50 | 2.54 | 2.34 |

The alloys were drawn with a final length change of 36 times original.

For an alloy to be considered acceptable for needle wire, the as-aged tensile strength and ductility are the key properties. The alloy should have a combination of annealed tensile strength and Work Hardening Rate (WHR) that yields finished wire with an as-drawn tensile, which, when combined with the aging response, has a total of approximately 360 ksi or greater, with acceptable ductility.

If we compare the as-drawn and aged tensile strength results reported for these 6 heats in Table 4b, with the chemical analysis in Table la (repeated above), we see that nickel levels below about 5.6% can not be strengthened to 360 ksi. This defines an additional relationship which is expressed as:

$$\text{Nickel}=5.6\%_{minimum} \quad (3)$$

Figure 3:
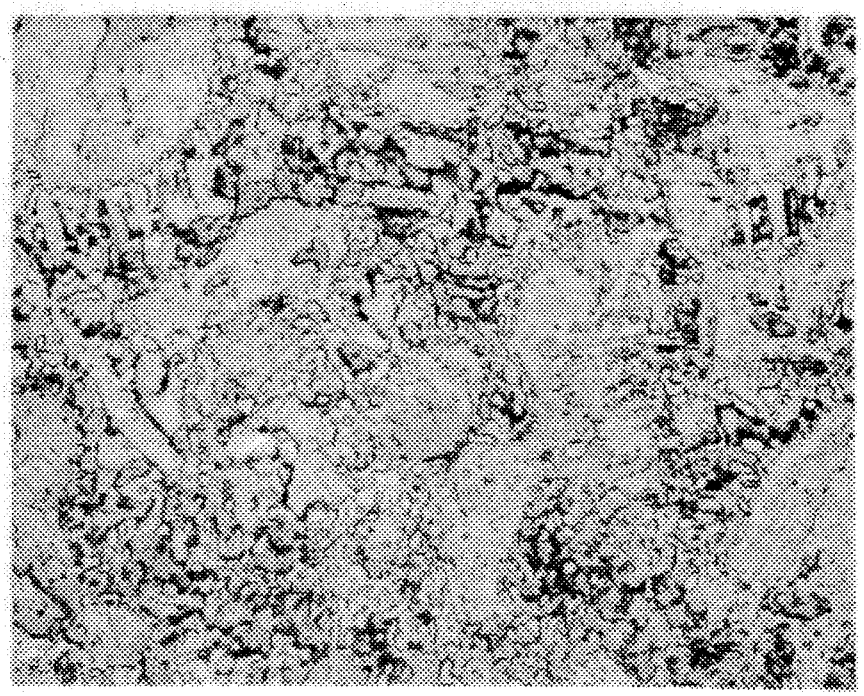
FIG. 3 is a scanning electron microscope photograph of C Chi phase in the martensitic matrix.

Also it was observed with the higher levels of Titanium and Molybdenum that a new phase identified as Chi (FIG. 3) forms in the martensitic matrix and results in a dramatic loss in ductility. The existence of Chi phase in the Chromium-Iron-Titanium ternary phase diagram and in the Chromium-Iron-Molybdenum ternary phase diagram is well known. However, there is no published information regarding the effect of Titanium and Molybdenum in combination on the formation of Chi phase.

It is thus desired to determine the effect that Titanium and Molybdenum have on the level of Chi phase formed. Samples were prepared for Chi phase percentage determination by X-Ray Diffraction. Table 6 shows the chemical composition of the ten samples used in this evaluation.

TABLE 6

Chi-phase amounts present in ten selected alloys

| ALLOY # | Ni | Ti | Mo | Ti + Mo | Amt. of Chi-phase |
|---|---|---|---|---|---|
| 105 A | 8.28 | 1.85 | 3.04 | 4.89 | 6.52 |
| 2527 B | 8.79 | 1.84 | 3.20 | 5.04 | 9.24 |
| 1983 B | 8.13 | 1.78 | 3.79 | 5.57 | 9.51 |
| 2177 B | 8.52 | 1.84 | 3.75 | 5.59 | 10.55 |
| 102 B | 8.27 | 1.88 | 4.06 | 5.94 | 20.13 |
| 30 | 8.53 | 2.53 | 4.03 | 6.56 | 19.34 |
| 106 C | 8.90 | 1.92 | 4.77 | 6.69 | 16.29 |
| 106 B | 8.50 | 1.93 | 4.77 | 6.7 | 22.15 |
| 31 | 8.54 | 2.03 | 5.03 | 7.06 | 20.77 |
| 29 | 6.87 | 2.43 | 5.02 | 7.45 | 27.42 |

(Note 1) Chromium held constant at 11.9% in all cases

The alloys were chosen to represent titanium with molybdenum contents ranging from approximately 4.8% to 7.5%. Each sample consisted of a piece of rod approximately ¼" in diameter and 2 to 4 inches in length. The samples were placed in the furnace and annealed for one-hour at 1800° F. and water quenched.

Figure 4:
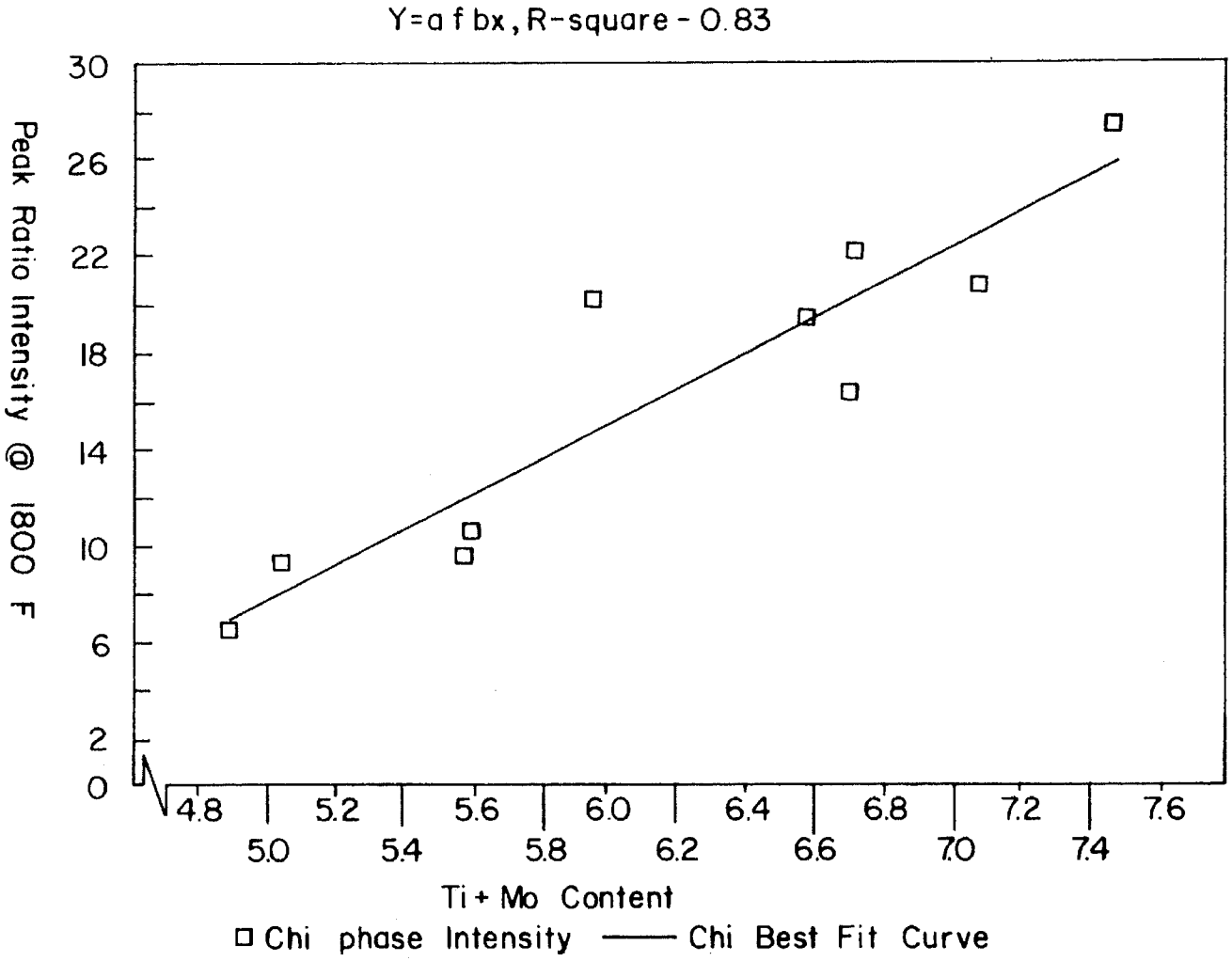
FIG. 4 is a plot of the best fit curve for the Chi phase versus titanium plus molybdenum.
Figure 5:
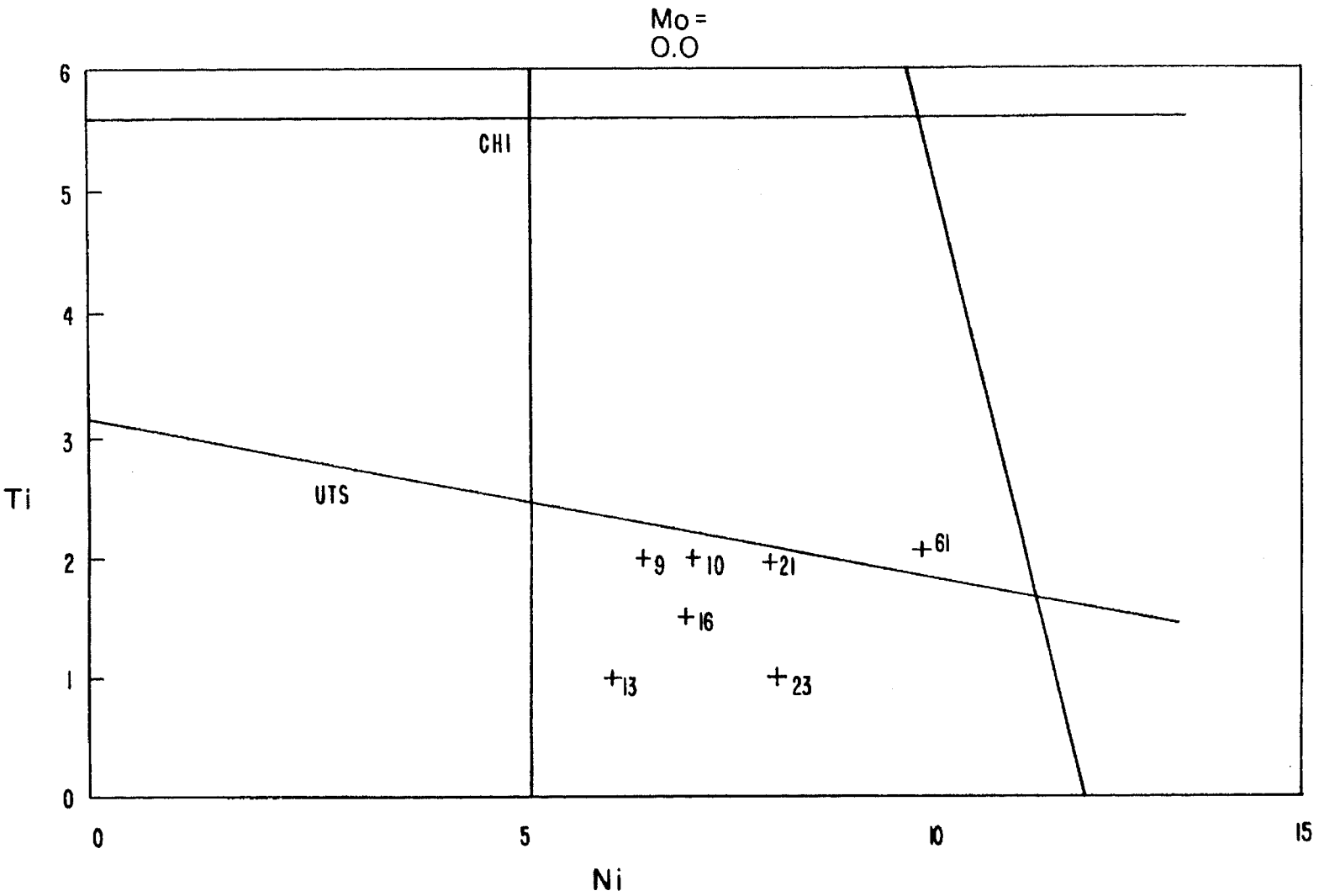
FIG. 5 is a planar graph developed from the four formulas of this invention with molybdenum held constant at 0%. The chemical composition yielding acceptable needle wire are represented by the area bounded by the four formulas.
Figure 6:
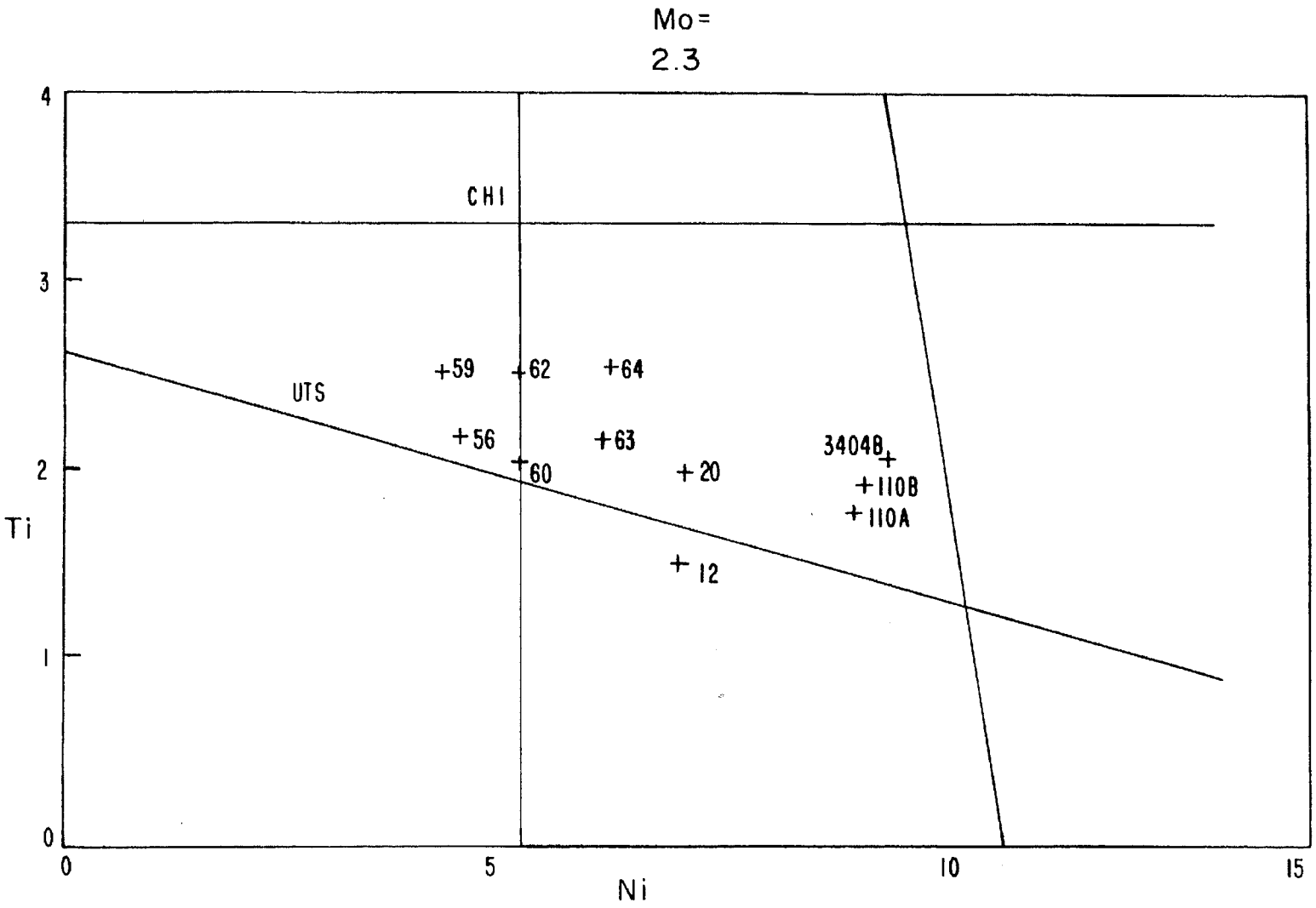
FIG. 6 is a graph similar to that described to FIG. 5 where the molybdenum level is held at 2.3%.
Figure 7:
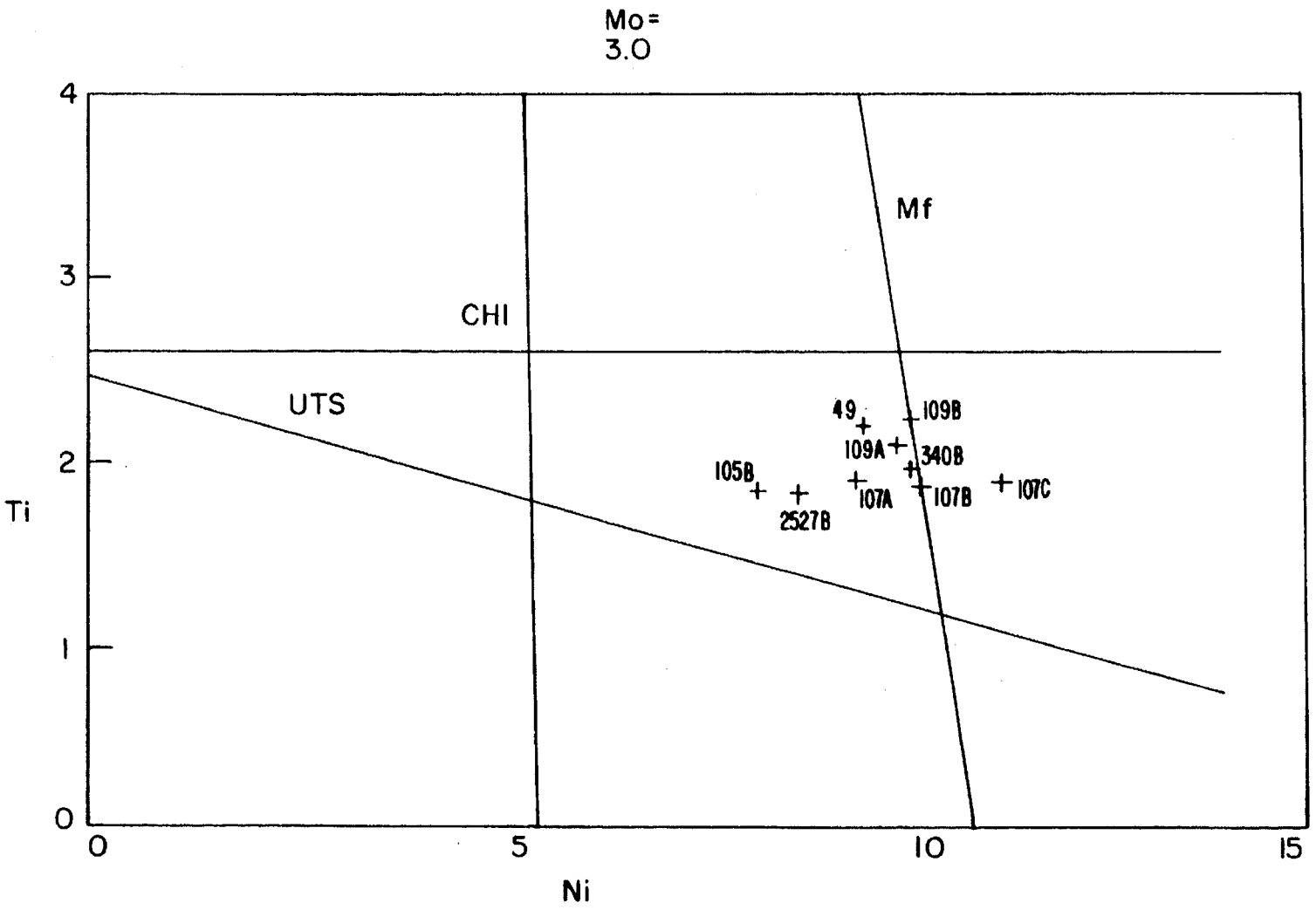
FIG. 7 is a similar graph as in FIGS. 5 and 6 and with molybdenum held at 3%.
Figure 8:
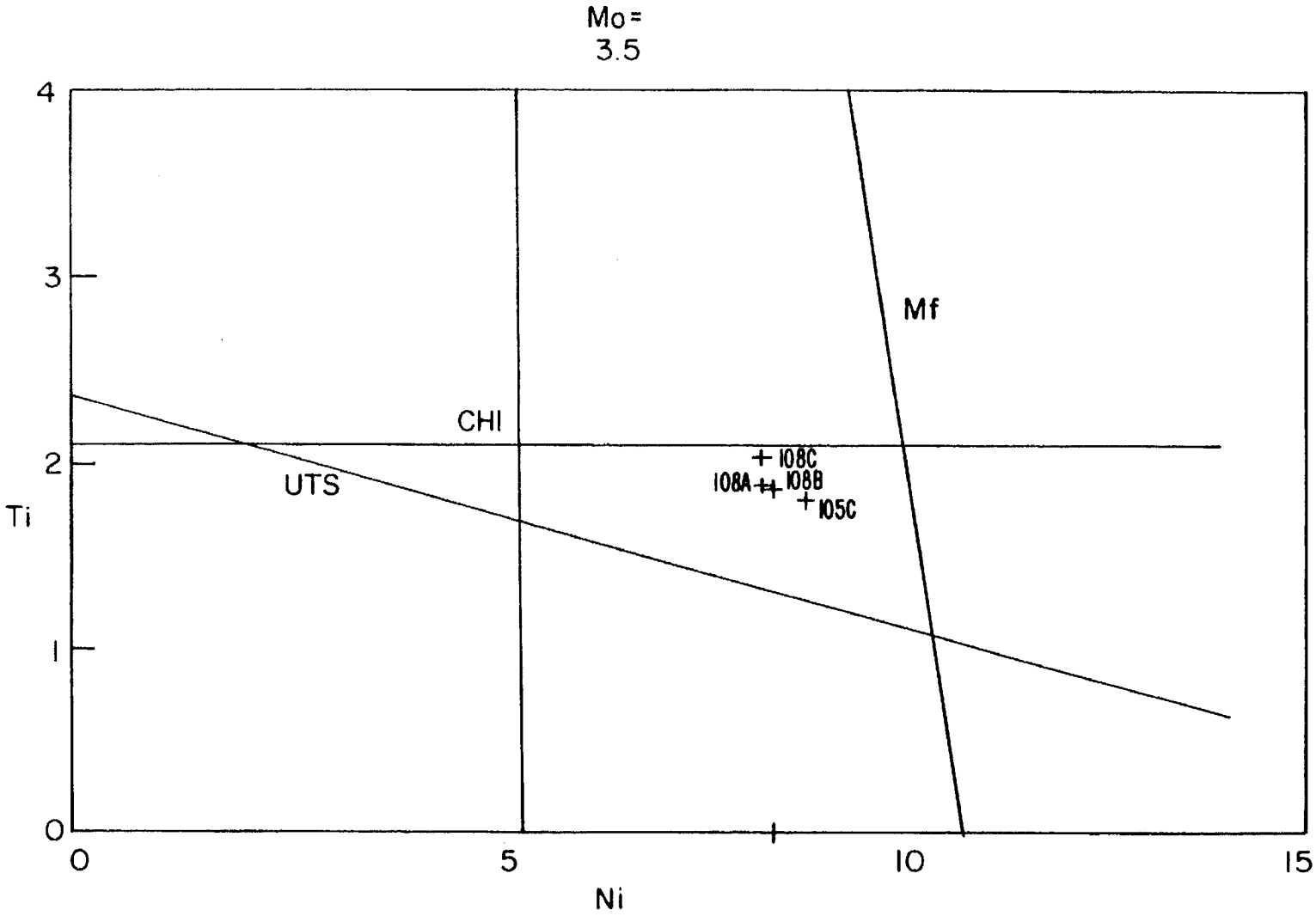
FIG. 8 is similar to graphs 5, 6, and 7 with the level of molybdenum level held at 3.5%.
Figure 9:
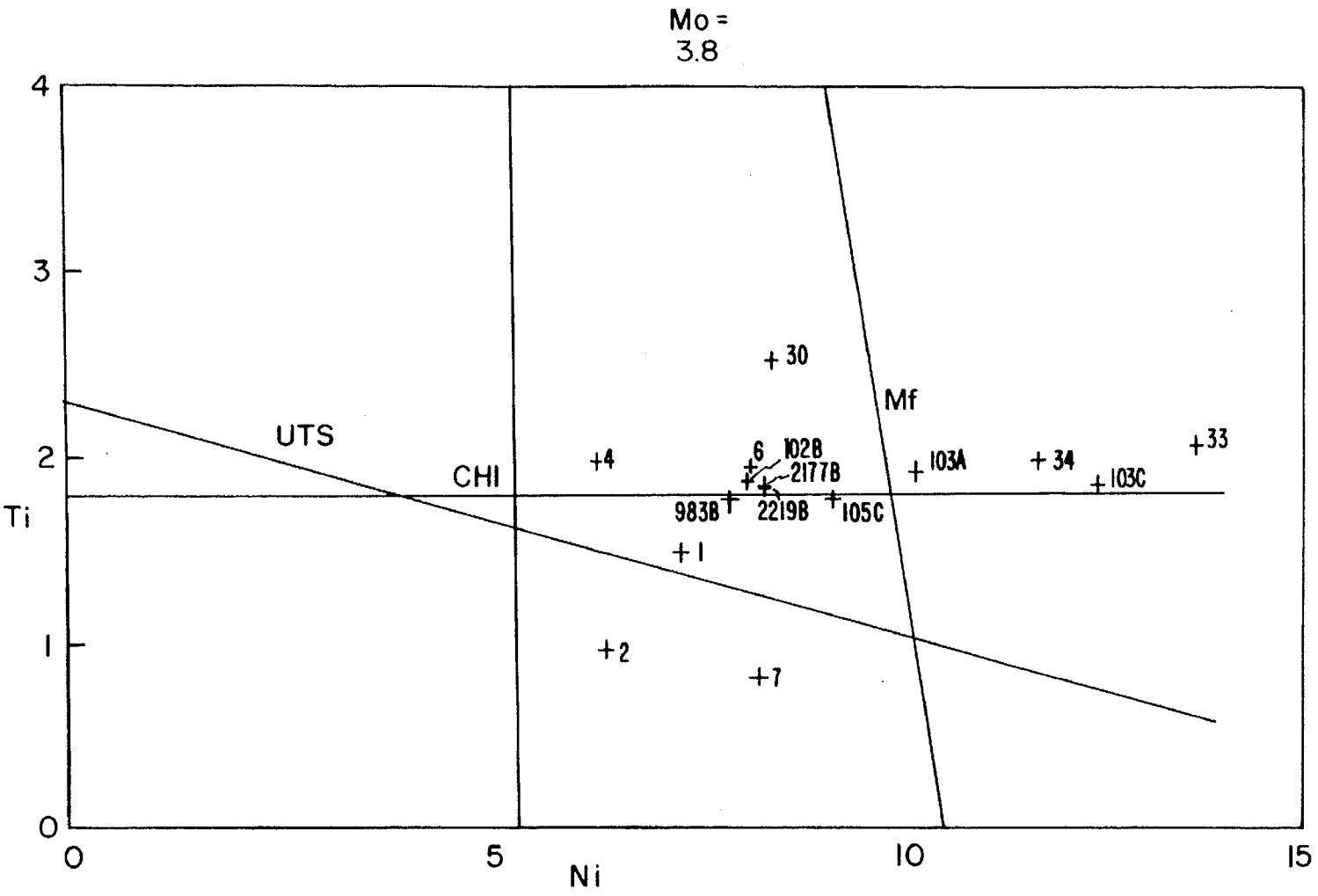
FIG. 9 is a graph showing similar results as in FIGS. 5–8 with molybdenum level held at 3.8%.
Figure 10:
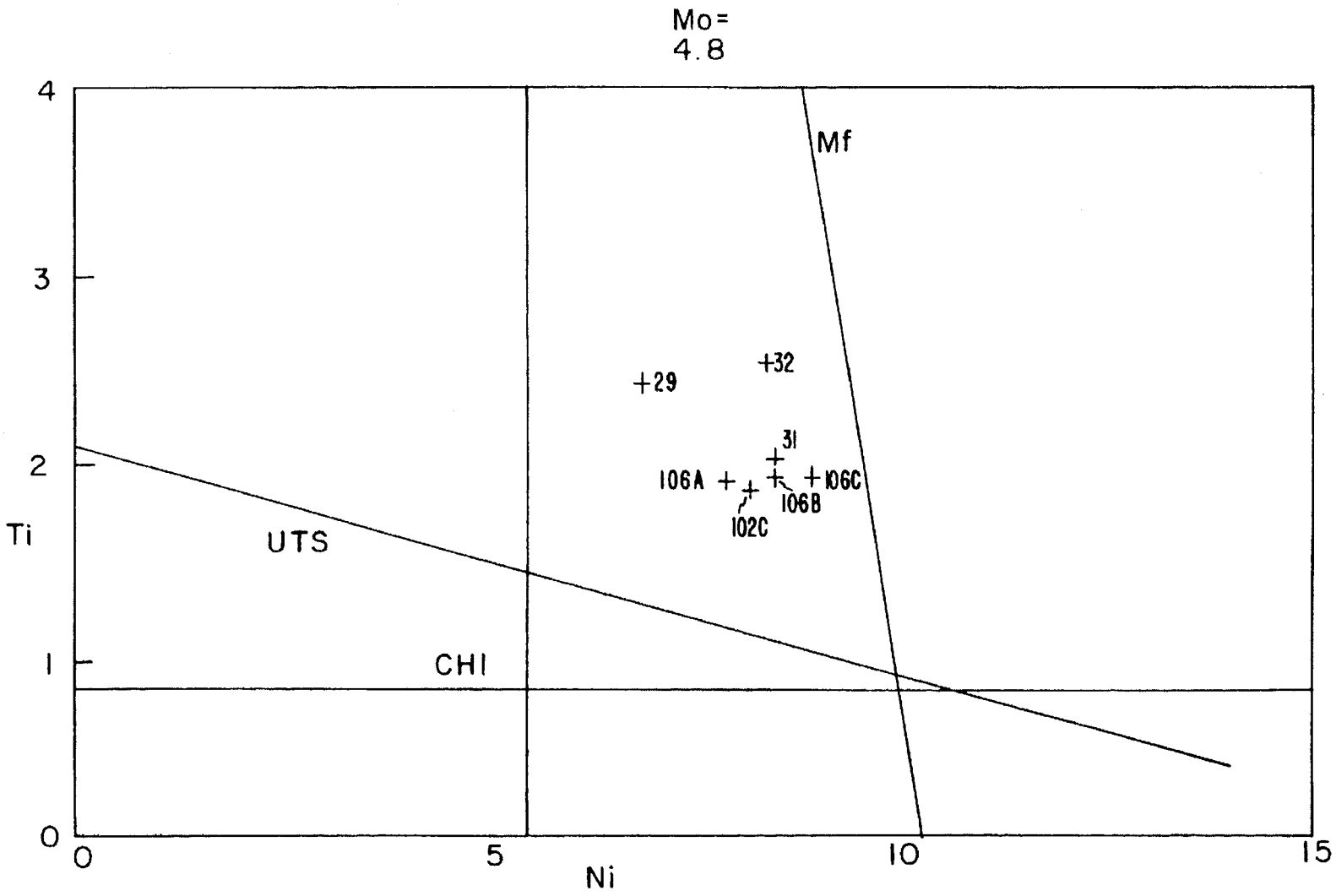
FIG. 10 is graph similar to FIGS. 5–9, but with molybdenum level held at 4.8%.
Figure 11:
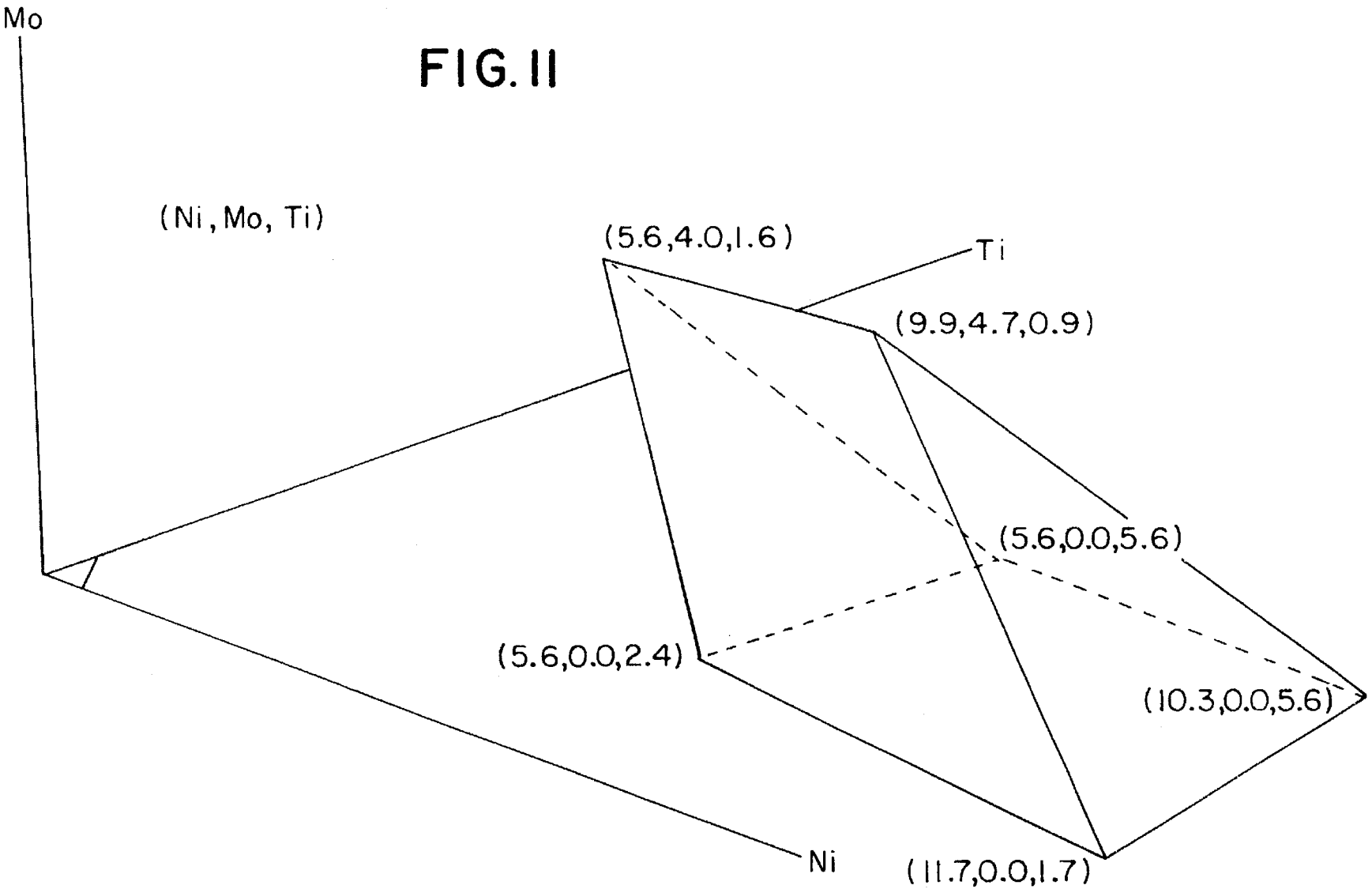
FIG. 11 is a spacial graph developed from the four formulas of this invention.

After annealing, each piece of rod was cut into five to ten thin wafers using an Isometer cutter. The thickness of each wafer was approximately 20-mils. The thin wafers were subjected to X-Ray Diffraction studies. The samples were further prepared by mechanically grinding them to 600 grit on both sides to obtain near parallel surfaces. The Chi phase percentages are reported in Table 6 and shown in FIG. 4. The data shows that the amount of Chi phase present increases linearly with increasing titanium with molybdenum content.

A mathematical model was used with the data from Table 6 to derive a relationship between chemical composition and amount of Chi phase present in NiTi alloys. The relationship is:

$$\%\ Chi = -28.6 + (7.3 * \%\ Ti) + (7.3 * \%\ Mo)$$

A measure of the goodness-of-fit to the data is the R-square value or the Coefficient of Determination. A model with a perfect fit (i.e., one in which the predicted values equal the observed values) would have an R-square of 1.0. The closer the R-square value is to 1.0, the closer a model fits the data. since the R-square value for the model proposed above was 0.83, it is concluded the model and the data fit well. Since the coefficients for titanium and molybdenum are equal, a formula predicting the tendency to form Chi phase in an alloy containing both titanium and molybdenum is expressed as follows:

$$Chi_{tendency} = \%\ Mo + \%\ Ti \quad (4)$$

Our studies showed that for materials annealed at the preferred range of 1980° F. to 2080° F. the Chi phase tendency should be less than 5.6 to insure acceptable ductility. If we solve the four equations simultaneously setting UTS equal to 360 ksi (minimum) $M_f$ equal to 70° F. (maximum), and % Ni equal to 5.6% (minimum), Chi phase tendency equal to 5.6 (maximum) and plot three-dimensionally, a series of acceptable chemistries results. That series is contained in a five-sided volume within Ni=5.6% to 11.7%, Ti=0.9% to 5.6%, and Mo=0% to 4.7%.

The following condition were then applied, as they comprise known conditions for strong needle wire alloys:

1. Ultimate tensile strength (UTS) must equal at least 360 ksi for a strong needle wire.
2. $M_f$ must equal at least 70° F. to insure complete martensite transformation and ductile needle wire.
3. % Nickel must more than 5.6% and preferably more than 8.0%, for a strong, corrosion resistant needle wire.
4. Chi phase tendency must be no more than 5.6% for a ductile needle wire.

The formulas then become:

$$144 \geqq (5.7 * Ni) + (46.4 * Ti) + (9.8 * Mo) + (30.5 * Ta)\ 957 \geqq (78 * Ni) + (27 * Ti) + (34 * Mo).$$

$$Nickel \geqq 5.6$$

$$5.6 \leqq Ti + Mo$$

These formulas were graphed as in FIGS. 5 through 11, as a function of Ni and Ti at various levels of Mo. The space within the highlighted shapes represent the compositions that will make a strong, ductile and corrosion resistant needle wire. Outside of these shapes are compositions that are predicted to be weak and/or brittle and/or lacking corrosion resistance, and thus unacceptable for surgical needle use.

The numbered data points represent the heats melted to date. They include the twenty-five heats discussed in the disclosure of U.S. Pat. No. 5,000,912, and twenty-eight new heats. There are twenty-four heats that fall within the shapes and twenty-nine that fall outside them. All of the heats fall in the properly predicted area or extremely close to it. Heats 2219 and 2177 on the Mo=3.8 graph (FIG. 9) have marginally acceptable ductility and, as can be seen, they reside directly on the Chi phase former line.

We have found that if it is required that the strength of the needle wire be at least 360 ksi, then the minimum nickel level must be above 5.6%, and the minimum titanium level must be above 1.0%.

A preferred chemistry within the boundaries established in FIGS. 5 through 10 would be, for instance nickel at about 10%, titanium at about 2%, and molybdenum at about 2.7%.

The acceptable steels all fall within these levels, and are reproduced in FIGS. 5 through 11, as well as the Tables contained herein. With the above tests, it has been determined that new subject matter exists in condition for a patent and it is intended that the following claims and their equivalents delineate the scope of that patent.

What is claimed is:

1. A surgical needle having a shaft and a sharpened tip at one end and formed from a martensitic stainless steel alloy and consisting of:

about 12.5% chromium by weight;

greater than 9.8% and less than about 10.1% nickel by weight;

molybdenum about 2.2% by weight;

the combination of tantalum and titanium about 2.3% by weight; and the remainder being iron with inevitable impurities less than 0.1% by weight.

2. The needle of claim 1 wherein the combination of titanium and tantalum is no higher than about 2.1%.

3. The needle of claim 1 of the amount of tantalum is substituted for up to 1% titanium in an amount equal to 1.5 times the titanium replaced.

4. The needle of claim 1 wherein the amount of titanium is about 2.1%.

* * * * *